US008408079B2

(12) United States Patent
Reichmuth et al.

(10) Patent No.: US 8,408,079 B2
(45) Date of Patent: Apr. 2, 2013

(54) PIPETTE

(75) Inventors: Burkhardt Reichmuth, Hamburg (DE); Herbert Belgardt, Hamburg (DE); Klaus Schuerbrock, Hamburg (DE)

(73) Assignee: Eppendorf AG, Hamburg (DE)

( * ) Notice: Subject to any disclaimer, the term of this patent is extended or adjusted under 35 U.S.C. 154(b) by 767 days.

(21) Appl. No.: 12/204,969

(22) Filed: Sep. 5, 2008

(65) Prior Publication Data

US 2009/0139351 A1 Jun. 4, 2009

(30) Foreign Application Priority Data

Sep. 5, 2007 (DE) ..... 10 2007 042 115

(51) Int. Cl.
*B01L 3/02* (2006.01)

(52) U.S. Cl. ..... 73/864.16

(58) Field of Classification Search ..... None
See application file for complete search history.

(56) References Cited

U.S. PATENT DOCUMENTS

| | | | | |
|---|---|---|---|---|
| 4,406,170 | A | 9/1983 | Kuhn | |
| 4,474,071 | A * | 10/1984 | Marteau d'Autry | 73/864.13 |
| 5,620,660 | A | 4/1997 | Belgardt et al. | |
| 2006/0263261 | A1 | 11/2006 | Lenz | |

FOREIGN PATENT DOCUMENTS

| | | | |
|---|---|---|---|
| DE | 29 26 691 | C2 | 5/1983 |
| DE | 43 41 229 | C2 | 7/1995 |
| DE | 199 17 907 | A1 | 9/2000 |
| DE | 10 2005 023 203 | A1 | 11/2006 |

* cited by examiner

*Primary Examiner* — Robert R Raevis
(74) *Attorney, Agent, or Firm* — Vidas, Arrett & Steinkraus

(57) ABSTRACT

A pipette with a pipette housing, in which are arranged an accommodation for the fastening portion of a syringe cylinder of a syringe, a plunger accommodation in an accommodation body for a syringe plunger of the syringe, fastening devices for reversibly fixing the fastening portion and the syringe plunger in the accommodations, and plunger setting devices for shifting the accommodation body in the pipette housing, with a pull-up member for removing the accommodation body from the accommodation, and an actuation member for drawing the accommodation body near to the accommodation.

19 Claims, 8 Drawing Sheets

FIG.3.1

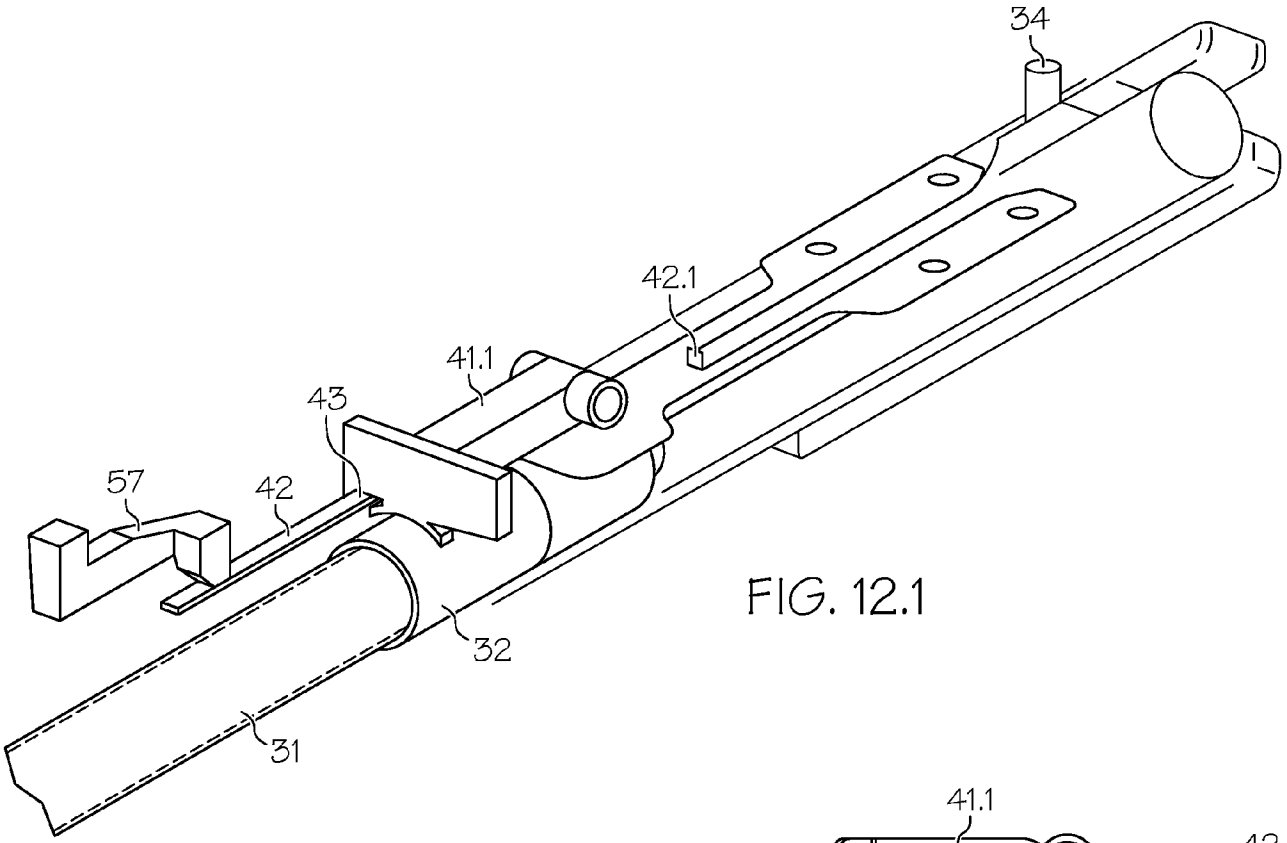
FIG. 12.1
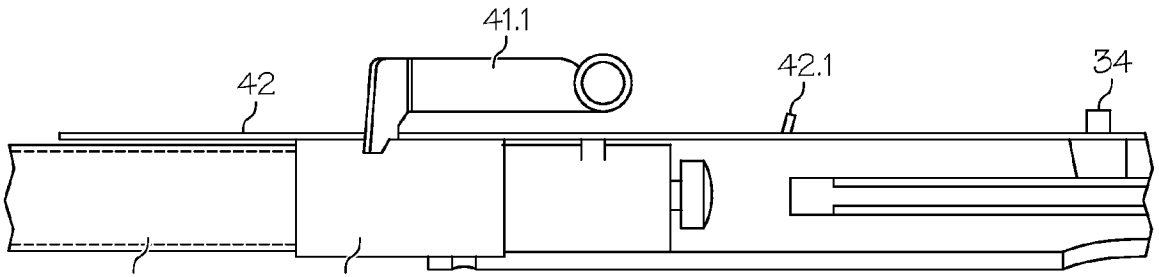
FIG. 7.1

PIPETTE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention is related to a pipette.

Pipettes are devices for gauging and transferring liquids. They are often realised as repetition or multi pipettes, which permit the stepwise delivery of a liquid from a syringe. A repetition pipette is known from DE 29 26 691 C2, the entire contents of which are incorporated herein by reference, respectively, or U.S. Pat. No. 4,406,170 A1, the entire contents of which are incorporated herein by reference, respectively, which describes the repetition mechanism of the repetition pipette in particular. It also describes the fastening of a syringe of the system on the repetition pipette. For this purpose, the syringe has a syringe flange, which is insertable into a laterally open, essentially U-shaped groove from out one side. An axial pressing spring fixes the inserted syringe flange in the groove. For the connection of the syringe plunger with a plunger setting device, there is an insert element, which receives an end portion of the syringe plunger between two cheeks. The cheeks can be pressed against the syringe plunger by means of a flap-shaped clamping member, whose actuation lever projects out of the housing via an opening. This syringe fixture has the disadvantage that the syringe has to be touched by the hand for insertion and coupling with the plunger setting device, or for uncoupling and take-out, respectively.

DE 43 41 229 C2, the entire contents of which are incorporated herein by reference, respectively or U.S. Pat. No. 5,620,660 A1, the entire contents of which are incorporated herein by reference, respectively, respectively, proposes a syringe system better suited for manual operation, with a syringe which can be simply axially thrusted into the pipette or axially removed from the same, respectively. This pipette system has a syringe featuring a fastening portion and a syringe plunger and a pipette which has an accommodation for the fastening portion and an accommodation body with a plunger accommodation for the syringe plunger. Further, there are fastening devices for reversibly fastening the fastening portion and the syringe plunger in the accommodations, and plunger setting devices for shifting the accommodation body in the pipette housing. The fastening portion and the syringe plunger are axially thrustable into their fastening positions via axial openings of their accommodations. The fastening devices have radially closable gripping devices for fastening the fastening portion and the syringe plunger in the fastening positions. The gripping devices have syringe gripping levers pivotally mounted in the pipette housing, and plunger gripping levers pivotally mounted in the pipette body. The syringe gripping levers and the plunger gripping levers are realised with two arms, a gripping arm and an actuation arm, wherein the syringe gripping levers have contact sites on the inner sides of their actuation arms, which, by actuating their actuation arms at the outside, are turnable against the actuation arms of the plunger gripping levers and which actuate the plunger gripping levers. Through this it is obtained that the syringe and the pipette are connectable with each other by a purely axial relative movement and are separable from each other by an actuation of the fastening devices.

According to one example of realisation, the user has to push the actuation arms of the syringe gripping levers towards the inside in order to separate the syringe from the pipette. In this, the gripping arms unlock the syringe flange and the unlocking cams of the syringe gripping levers press the actuation arms of the plunger gripping levers, so that the same unlock the syringe plunger. Preloaded helical springs of a flange abutment press towards the axial opening of the repetition pipette in order to eject the syringe. For detaching the syringe from the pipette, the two syringe gripping levers have to be actuated with two fingers at the same time.

From DE 10 2005 023 203 A1, the entire contents of which are incorporated herein by reference, respectively or US 2006 26 32 61 A1, the entire contents of which are incorporated herein by reference, respectively, respectively, a pipette is known in which the syringe can be detached from the pipette by actuating only one detachment trigger. For this purpose, the syringe gripping levers have releasing levers projecting towards the inside on the actuation arms in a pipette which is provided with fastening devices for reversibly fastening syringes according to DE 10 2005 023 203 A1 or US 2006 26 32 61 A1, respectively. Further, a transfer element, shiftably guided in the pipette housing transversely with respect to the releasing levers in at least one guiding, can be brought into abutment on the two releasing levers with an abutment surface at the front side by shifting it in the guiding. In addition, a detachment trigger displaceably arranged in the pipette housing is coupled with the transfer element, in order to shift the transfer element in the guiding when the detachment trigger is displaced. For actuating the actuation members of the plunger setting devices and the detachment trigger, the user has to change his/her grip.

From DE 199 17 907 A1, the entire contents of which are incorporated herein by reference, respectively, a pipette for a pipette system with pipette and syringe is known, which has a cylinder, a flange and a plunger with a plunger head. In a pipette housing, a plunger setting device is axially shiftable. On the pipette housing, a cylinder gripping device fro the flange of the syringe is mounted to be axially accessible. On the plunger setting device and shiftable with the same, a plunger gripping device for the plunger head is mounted to be axially accessible. Further, an actuation device for the cylinder gripping device and the plunger device is stationarily mounted on the pipette housing. The gripping devices feature radially closable cylinder gripping levers and plunger gripping levers, which are normally in the gripping position and which can be brought into a releasing position by actuating the actuation device, in which the flange and the plunger head of a syringe are released for take-out or for reception. On the pipette housing, the actuation device has a central actuation element, actuatable from the outside, whose movement when actuated is transferred to the cylinder gripping levers via a first force transmission train on the one hand, and on the other hand to the plunger gripping levers via a second force transmission train.

The cylinder gripping levers or the plunger gripping levers can be in the gripping position under spring force, and can be brought into the releasing position against the spring force. Further, two cylinder gripping levers and two plunger gripping levers standing opposite to each other can be provided, and the central actuation element can extend to both of the two pairs of gripping levers in the pipette housing. The force transmission trains can be constituted by wedge mechanisms between the actuation element and the respective gripping levers. According to a further embodiment, the second force transmission train is closed only when the plunger setting device is completely pushed up.

When liquid is delivered stepwise with a syringe, the plunger setting device is actuated from the upside by hand or through a motor. The actuation element, actuatable from the outside, of the actuation device is executed as an actuation key for instance, which is arranged below on one side of the pipette housing. Even with this pipette, the user has to change his/her grip, when he/she wants to actuate the actuation element for discarding a syringe after actuating the plunger setting device.

BRIEF SUMMARY OF THE INVENTION

The pipette according to the present invention has a pipette housing, in which are arranged an accommodation for the fastening portion of a syringe cylinder of a syringe, a plunger accommodation in an accommodation body for a syringe plunger of the syringe, fastening devices for reversibly fixing the fastening portion and the syringe plunger in the accommodations, and plunger setting devices for shifting the accommodation body in the pipette housing, with a pull-up member for removing the accommodation body from the accommodation, and an actuation member for drawing the accommodation body near to the accommodation, wherein the fastening devices feature releasing means, an ejection slider can be displaced into a releasing position in the movement range of the actuation member from a holding position outside the movement range of the actuation member, so that it can be shifted along a housing-stationary guiding by actuating the actuation member in order to actuate the releasing means, and there are means for displacing the ejection slider from the holding position into the releasing position and from the releasing position into the holding position.

The pipette of the present invention has fastening devices for reversibly fastening a syringe, which correspond to the fastening devices of DE 10 2005 203 203 A1 or US 2006 26 32 61 A1, respectively, or to those of DE 199 17 907 A1. By means of the fastening devices, a syringe can be fixed in the pipette in a known manner. By actuating the pull-up member, liquid can be aspirated into the pipette. In addition, the fastening devices are provided with releasing means, and an ejection slider is shiftable against the releasing means along a guiding. However, the ejection slider is not associated to one particular release trigger, but to an actuation member of the plunger setting devices. Thus, a particular release trigger does not apply. In addition, the ejection slider is not displaceable into a releasing position inside the movement range of the actuation member exclusively along the guiding, but also from out a holding position outside of the movement range of the actuation member. For this purpose, there are means for displacing the ejection slider from the holding position into the releasing position, and back. Before the delivery of liquid, the ejection slider is brought into the holding position. Thereafter, the actuation member can be actuated once or plural times for the delivery of liquid from the syringe in one single or plural steps, without that the syringe is detached. After completion of the delivery of liquid, the ejection slider is displaced into the releasing position and discarding the syringe is caused by actuating the actuation member. After discarding the syringe, the ejection slider is brought into the holding position for a new metering. The user does not have to change his/her grip and one-hand operation of the pipette is facilitated.

According to one embodiment of the present invention, the fastening portion and the syringe plunger are axially shiftable into their fastening positions via axial openings of their accommodations.

According to a further embodiment, the fastening devices have radially closable gripping devices for fixing the fastening portion and the syringe plunger in the fastening positions.

According to a further embodiment, the gripping devices feature syringe gripping levers, pivotally mounted in the pipette housing, and plunger gripping levers, pivotally mounted in the accommodation body, the syringe gripping levers and the plunger gripping levers being realised with two arms, namely with a gripping arm and an actuation arm, the syringe gripping levers having contact sites on the inner sides of their actuation arms, which, by actuating their actuation arms at the outside, are turnable against the actuation alms of the plunger gripping levers and which actuate the plunger gripping levers, and the syringe gripping levers have releasing levers projecting towards the inside on their actuation arms, which are the releasing means.

In the embodiments described above, the fastening devices of the pipette are realised such as is described in DE 10 2005 023 203 A1 or US 2006 26 32 61 A1, respectively. The explanations concerning this matter in the document cited above are incorporated into the present application by reference. The fastening devices of the pipette of the present invention can be also realised otherwise, like described in DE 199 17 907 A1 for instance. In this design of the fastening device, releasing means which are actuable by the ejection slider can be formed by the bow- or strap like actuation element, which extends towards both gripping levers at a time according to an example of realisation. The explanations concerning this matter of DE 199 17 907 A1 are also incorporated into the present application by reference.

The fastening elements can be brought into a position in which they fix the fastening portion and the syringe plunger with the accommodations in different ways. For instance, they can be brought into this position by spring devices or by the force of gravitation. Further, it is possible that the fastening means have an actuation mechanism by which they are brought into the mentioned position in or after the insertion of the fastening portion and the syringe plunger of a syringe into the accommodations. For instance, the actuation mechanism can be actuated manually and/or be controlled by the insertion of the fastening portion or the syringe plunger, respectively, into the accommodations.

The means for displacing the ejection slider from the holding position into the releasing position and back can be realised in different ways. According to one embodiment, the means for displacing the ejection slider are coupled to the plunger setting devices in order to displace the ejection slider from the holding position into the releasing position and from the releasing position into the holding position. For instance, the displacement is caused by actuating the pull-up member, wherein the displacement direction of the pull-up member determines the displacement direction of the ejection slider.

According to one embodiment, the means for displacing the ejection slider have a manually actuatable adjustment member which can be adjusted into a first adjustment position for displacing the ejection slider into the holding position, and into a further adjustment position for displacing the ejection slider into the releasing position. For instance, the adjustment member is an adjustment lever, which causes a displacement of the ejection slider against a spring tension, via an axis and a control cam fixed thereon.

In principle, the pipette can be designed such that the syringe can be detached from the pipette even in a filled of partly filled state. According to a preferred embodiment, the ejection slider can be displaced from the holding position into the releasing position and from the releasing position into the holding position by means of the means for displacing the ejection slider only when the accommodation body is arranged in an end portion of its displacement range near to the accommodation. Through this, it is made sure that the syringe is detached only when its content has been delivered completely or almost completely, respectively. Preferably, the displacement of the ejection slider into the releasing position is restricted to a remaining stroke of the accommodation body for the delivery of a residual amount of the liquid from the syringe, which is smaller than a preset metering amount.

According to a preferred embodiment, the pipette has means for automatically suspending the displaceability of the accommodation body by means of the actuation member when the accommodation body arrives in the end portion of its displacement range in which the available remaining stroke falls below a preset metering stroke which is needed to deliver a preset metering amount. By the automatic suspension of the actuation member, the user recognises that the preset metering amount is no more available. Unintended metering of a too small residual amount is effectively prevented through this.

The delivery of a residual amount can take place in different ways. According to one embodiment, the accommodation body is displaceable by actuating the pull-up member in the end portion of its displacement range. Thus, the user can cause the delivery of the residual amount by purposeful actuation of the pull-up member. When the plunger setting devices are coupled with the means for displacing the ejection slider, the displacement of the ejection slider from the holding position into the releasing position is caused at the same time by this. After the delivery of the residual amount, the syringe can be ejected by purposeful actuation of the actuation member. After the insertion of a new syringe, liquid is aspirated into the syringe by displacing the pull-up member, wherein the accommodation body is moved even exceeding the end portion. In this, the ejection slider can be displaced from the releasing position into the holding position due to the coupling of the means for displacing the syringe with the plunger setting devices.

According to another embodiment, the pipette has means for cancelling the automatic suspension of the displaceability of the accommodation body by means of the actuation member which have a manually actuatable adjustment member, which is settable between a first adjustment position in which the automatic suspension is active, and a further adjustment position in which the automatic suspension is cancelled. When the adjustment member is in the first adjustment position, the displacement of the accommodation body by means of the actuation member is automatically suspended when there is still only an insufficient residual amount in the syringe. Then, the user can shift the adjustment member into the further adjustment position, so that the automatic suspension of the displaceability of the accommodation body by means of the actuation member is cancelled. Through this, the user can purposefully achieve that the residual amount can be delivered by actuating the actuation member. Unintended delivery of the residual amount is avoided. After the delivery of the residual amount, the adjustment member is already in the further adjustment position according to the embodiment described above, or it is brought into this further adjustment position, respectively, in order to bring the ejection slider into the releasing position. Thereafter, the syringe can be discarded by actuation of the actuation member. Thereafter, a new syringe can be inserted. After the adjustment of the adjustment member into the first adjustment position, liquid can be aspirated into the syringe by actuating the pull-up member. Thereafter, liquid can be delivered anew by actuation of the actuation member, until this is automatically suspended when arriving at an insufficient residual amount.

The coupling of the means for displacement of the ejection slider with the plunger adjustment devices can be realised in different ways. According to one embodiment, the ejection slider has a take-along surface, which is arranged in the movement range of a take-along element connected to the accommodation body, in order to take along the ejection slider in an end portion of the movement of the accommodation body towards the accommodation from the holding position into the releasing position. Further, the ejection slider has guiding means and the pipette housing has further guiding means, which guide the ejection slider from the holding position into the releasing position. For instance, the guiding means and the further guiding means are designed such that they guide the ejection slider, which is arranged continuously in the housing-stationary guiding with its end facing the releasing levers, into the movement range of the actuation member by a swivelling movement. Further, the ejection slider is provided with a further take-along surface, which is arranged in the movement range of a further take-along element, connected to the accommodation body, in order to take along the ejection slider in the movement of the accommodation body away from the accommodation into the holding position, wherein the further take-along element comes out of engagement with the further take-along surface when the ejection slider arrives in the holding position. In this embodiment, the ejection slider is moved along over a certain distance in the end portion of the movement of the accommodation body towards the accommodation, so that it arrives from the holding position into the releasing position by the guiding means. In the back movement of the accommodation body, the ejection slider is displaced back from the releasing position into the holding position by the further take-along element. Thereafter, the pipette is ready for the delivery of liquid again, without that the actuation of the actuation member causes an ejection of the syringe.

The ejection slider can be designed in different ways. According to one embodiment, it has two parallel rods, which are connected with each other by transversely directed bracing struts.

According to a further embodiment, the ends of the ejection slider with the front sides of the rods and/or of the bracing struts arrive in the movement range of the actuation member and of the releasing levers.

According to a further embodiment, the take-along surface and the further take-along surface are arranged on sides of the bracing struts which face each other.

According to a further embodiment, the take-along element is the housing of a spigot accommodation for a spigot of the pull-up member. Preferably, the housing is fixed directly on the accommodation body.

According to a further embodiment, the further take-along surface and the further take-along element are ramp elements and/or cam elements of the ejection slider and the accommodation body. The ramp elements and/or cam elements come into engagement with each other when the ejection slider arrives in the releasing position. They detach from each other when the ejection slider arrives in the holding position.

According to a further embodiment, at least one ramp element and/or cam element is arranged on a tongue connected with the accommodation body, which is directed into the displacement direction of the accommodation body. For instance, this element is formed by a ramp-like inclined delimitation wall of a depression in the tongue.

According to a further embodiment, at least the ramp element and/or the cam element of the ejection slider is arranged on a bracing strut. For instance, this ramp element is constituted by a cam with a ramp-like running flank.

According to one embodiment, the guiding means and the further guiding means are further ramp elements and/or cam elements on the ejection slider and the pipette housing. The ramp elements and/or cam elements co-operate in the displacement of the ejection slider by the plunger accommodation, so that the ejection slider arrives into the releasing position from the holding position. Reversely, they permit a return of the ejection slider into the holding position in the back movement of the plunger accommodation.

The actuation member can actuate the ejection slider directly or indirectly. According to one embodiment, the actuation member is connected with a stop, whose front side is associated to one end of the ejection slider in order to push the ejection slider from the releasing position against the release levers. The stop can serve to cover up a housing opening through which the actuation member is guided out of the pipette housing towards the outside.

The pipette may be an (electro-) motor driven pipette. According to a further embodiment, the pipette has manually driven plunger setting devices. In this, it may be dealt with plunger setting devices which are described in DE 29 26 690 C2 or U.S. Pat. No. 4,406,170 A1, respectively, or in DE 43 42 229 C2 or U.S. Pat. No. 5,620,660 A1, respectively. The explanations of the repetition mechanism in the two cited documents are incorporated into the present application by reference. Further, it may be equipped with a mechanism for realising a constant first stroke, as described in DE 44 14 760 C1 or U.S. Pat. No. 5,591,408 A1, respectively. Even the description related to this matter is incorporated into the present application by reference. Further, the plunger setting devices can be designed as indicated in DE 44 37 716 C2. The description related to this matter is also incorporated into the present application by reference.

The pipette can be realised as a stationary pipette. According to a preferred embodiment, it is a handheld pipette.

BRIEF DESCRIPTION OF THE SEVERAL VIEWS OF THE DRAWINGS

The present invention is explained in more detail in the following, by means of the attached drawings of examples of its realisation. In the drawings show:

FIG. 3.1 the fixture of a syringe in the accommodation of a pipette in partial section;

FIG. 7.1 plunger setting devices in a magnified perspective view;

FIG. 12.1 plunger setting devices in a magnified partial perspective view.

DETAILED DESCRIPTION OF THE INVENTION

Figure 10:
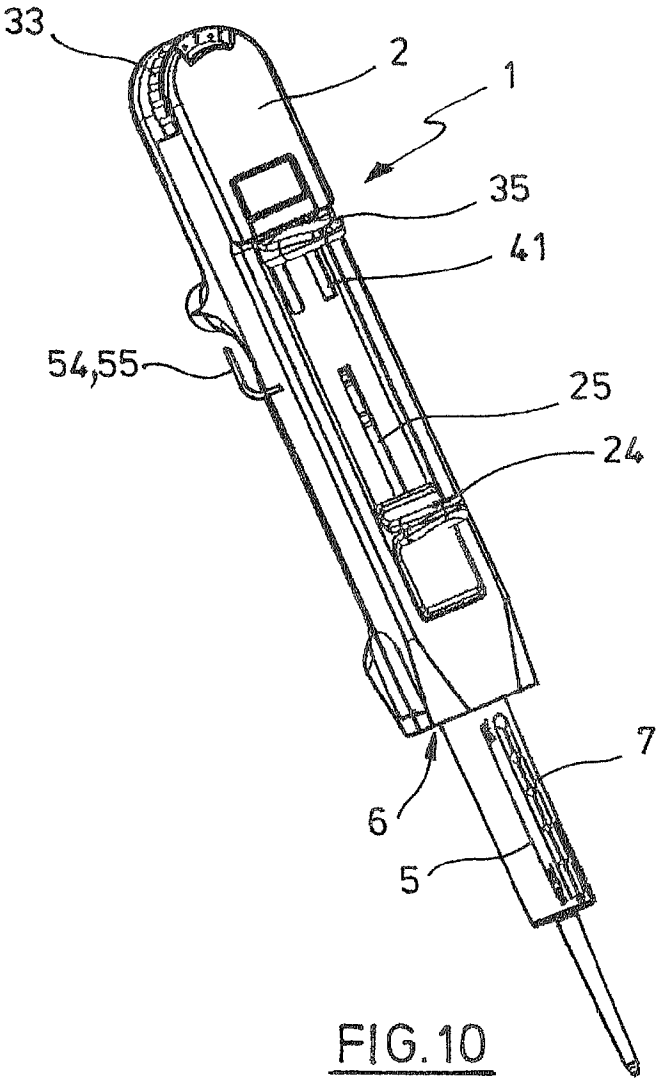
FIG. 10 a pipette with an adjustment member for switching from the metering operation to residual amount delivery and to syringe delivery, with inserted syringe in a perspective view.

While this invention may be embodied in many different forms, there are described in detail herein a specific preferred embodiment of the invention. This description is an exemplification of the principles of the invention and is not intended to limit the invention to the particular embodiment illustrated In the following, the designations "downside", "below" and "upside", "above" are related to the orientation of the pipette with syringe held downward.

Coincident assembly parts of different examples of realisation are indicated by the same reference numerals.

Figure 1:
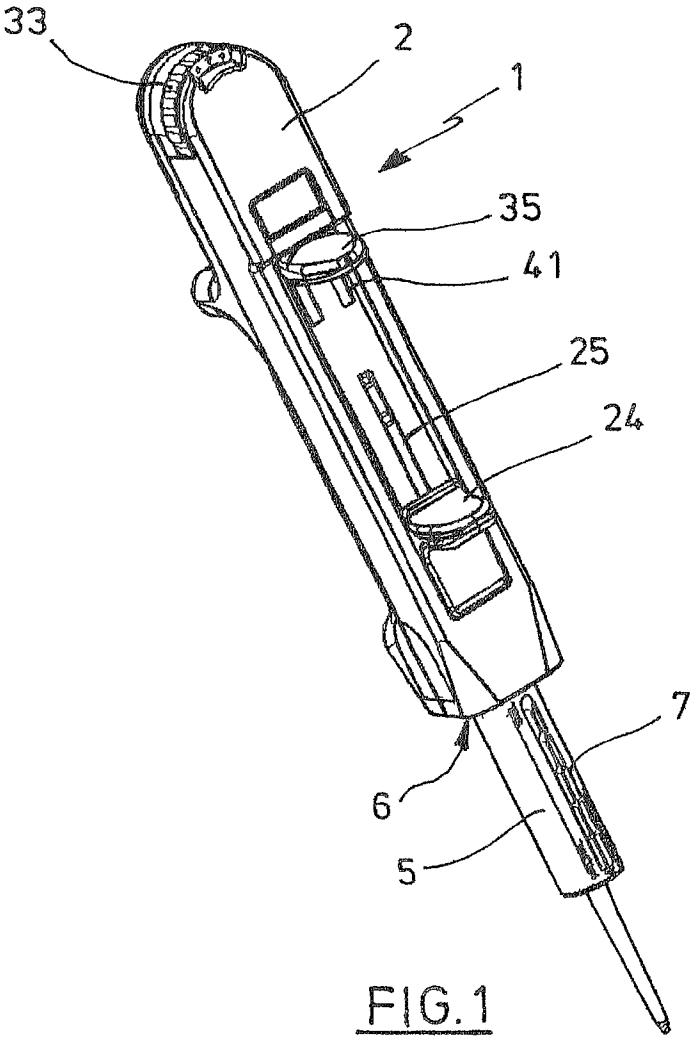
FIG. 1 a pipette with a remaining stroke delivery controlled by a pull-up member, with inserted syringe, in a perspective view.
Figure 3:
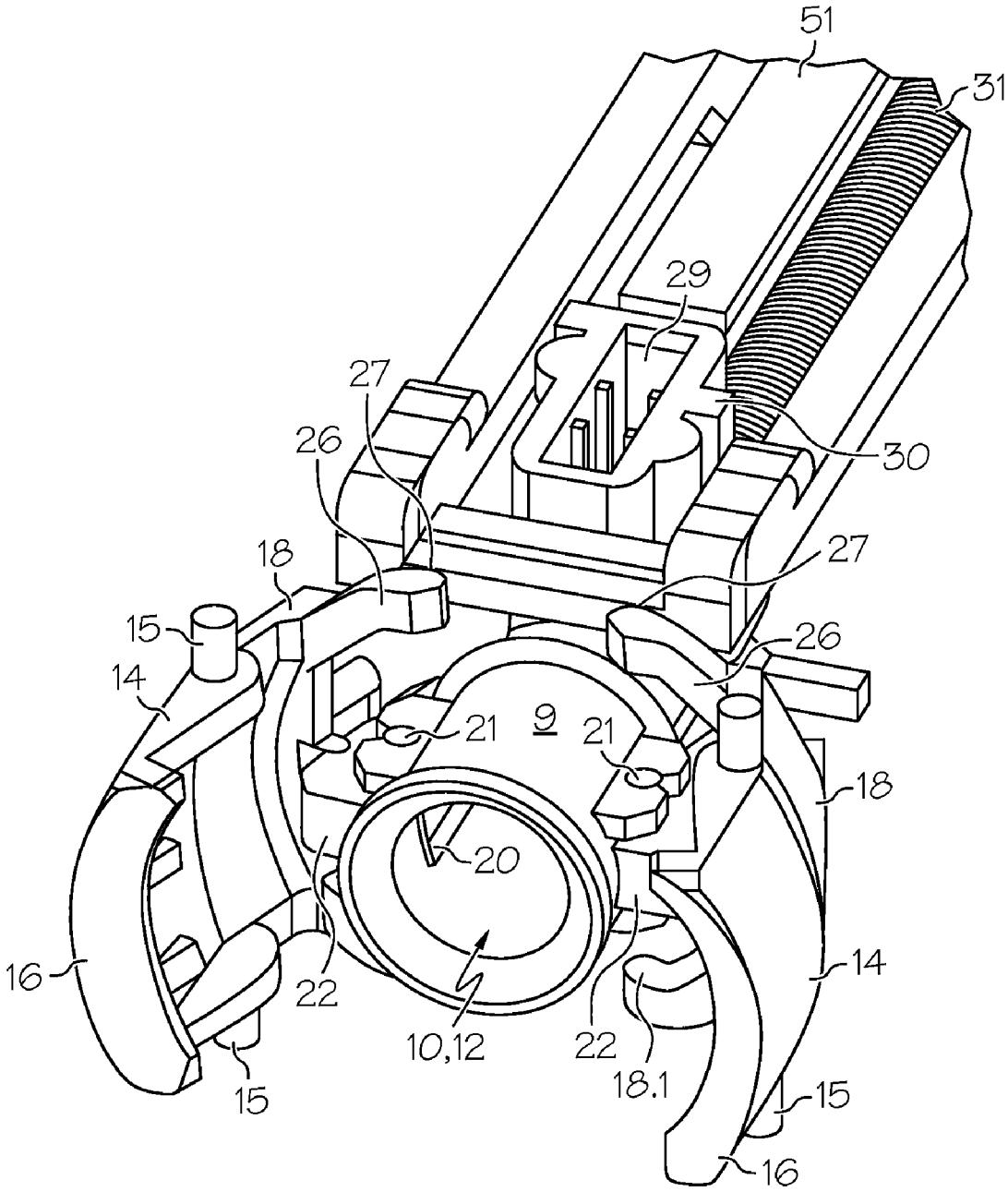
FIG. 3 a detail of the fastening devices and the ejection slider in a magnified perspective view.

According to FIGS. 1 and 3.1, a pipette 1 has an oblong pipette housing 2. In the lower end region of the pipette housing 2, there is arranged an accommodation 3 for a syringe flange 4 of a syringe 5. The syringe flange 4 is a fastening portion of the syringe 5. On the lower end of the pipette housing 2, the accommodation 3 has an axial bore 6, through which the syringe 5, held in the accommodation 3, stands out with its syringe cylinder 7.

A spring-tensioned abutment 8 is arranged in the accommodation 3, against which the upper side of the syringe flange 4 can be pressed. The abutment 8 has sensors 8.1 for scanning an encoding on the upper side of the syringe flange 4.

Figure 2:
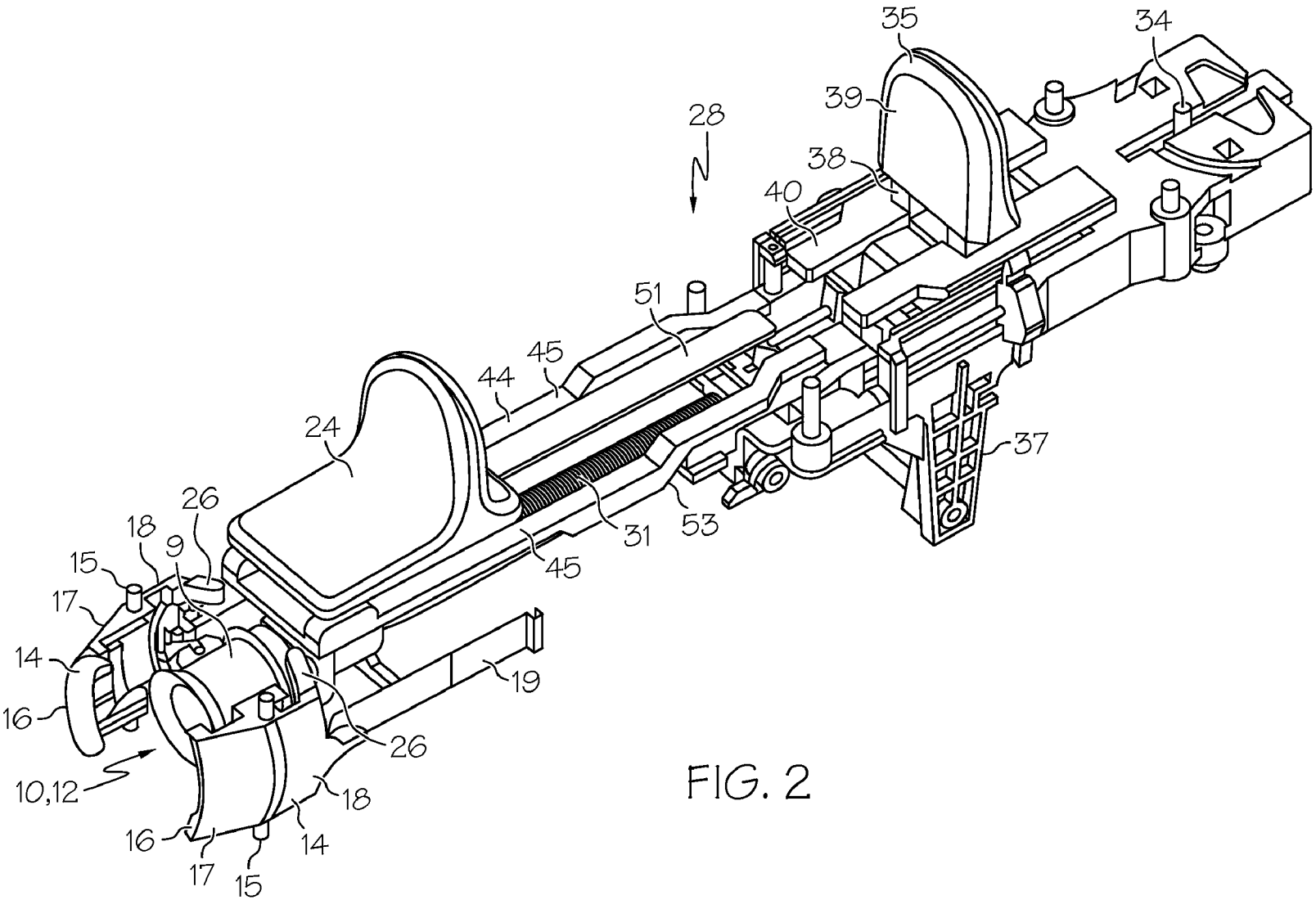
FIG. 2 fastening devices, plunger setting devices and ejection slider of the same pipette in a perspective view.

In the pipette housing 2, there is arranged an accommodation body 9 with a plunger accommodation 10, into which an end portion projecting towards the upside of a syringe plunger 11 of the syringe 5 is insertable (FIG. 2, 3, 3.1). In this, the syringe plunger 11 stands out into the inside of the accommodation body 9 through an axial opening 12 of the plunger accommodation 10. The upper end of the syringe plunger 11 can abut against a plunger stop, which is formed by a bottom of the plunger accommodation 10.

For fixing the syringe flange 4 in the accommodation 3, syringe gripping levers 14 are mounted in the accommodation 3 on swivelling axles 15 in the lower region of the pipette housing 2 in diametrically opposing bearings 13 on both sides of the accommodation 3. The syringe gripping levers 14 are enclosed by the pipette housing 2. They are provided with hook-shaped gripping ends 16, by which they can grasp behind the lower side of the syringe flange 4 when the same is inserted into the accommodation 3 and sits close to the abutment 8.

The syringe gripping levers 14 are arranged below the swivelling axles 15 with a gripping arm 17. An actuation arm 18 of the syringe gripping levers 14 is located above the swivelling axles 15. (FIGS. 2 and 3.1)

On the inner shell of the pipette housing 2, two leaf springs 19 are arranged, which are fixed in the lower region of the pipette housing 2 with their upper ends. The lower end of the leaf springs 19 push against the inner sides of the syringe gripping levers 14.

The syringe gripping levers 14 are prestressed in the direction towards the position grasping behind the syringe flange 4 by the leaf springs 19.

On the inner sides of their actuation arms 18, the syringe gripping levers 14 each at a time carry one unlocking cam, which is directed towards the accommodation body 9.

The accommodation body 9 is provided with breakthroughs 20 (FIG. 3) on sides diametrically opposing each other. In these breakthroughs 20, plunger gripping levers 22 are mounted on the accommodation body 9 on swivelling axles 21. The plunger gripping levers 22 can grasp behind a plunger collar 23 on the outermost end of the syringe plunger 11. For this purpose, they have an approximately wedge-shaped gripping arm, which is arranged above the swivelling axles 21. Below the swivelling axles 21, they have an actuation arm. Altogether, the plunger gripping levers 22 have an approximately lozenge-shaped contour.

The gripping levers 14, 22 each at a time have lever arms of about equal length. However, the plunger gripping levers 22 are shorter than the syringe gripping levers 14.

Not shown leg springs are arranged on the swiveling axles 21 of the plunger gripping levers 22, which prestress the plunger gripping levers 22 in the direction of a position in which they grasp behind the plunger collar 23. The outer side of the actuation arm of the plunger gripping levers 22 is formed such that in this locking position, they are in the swivel range of the unlocking cams on the inner side of the syringe gripping levers 14. The plunger gripping levers 22 are provided with swiveling axles 21 and a gripping arm arranged above the swiveling axles 21 and an actuation arm below the swiveling axles 21. The leg springs (not shown) are arranged on the swiveling axles 21 of the plunger gripping levers 22, which pre-stress the plunger gripping levers 22 in the direction of a locking position in which they grasp behind plunger collar 23. On each actuation arm 18 of the syringe gripping levers 14 an unlocking cam 18.1 (FIG. 3) is arranged which is directed towards the accommodation body 9. The unlocking cam 18.1 is visible especially in FIG. 3 which is located beneath plunger gripping lever 22 on inner side of actuation arm 18 belonging to left hand syringe gripping lever 14. The correct orientation of the plunger gripping levers 22 towards the syringe gripping levers 14 is made sure by the guiding of a pull-up member 24 in an axial slit 25 of the pipette housing 2 (FIG. 1). The plunger gripping levers 22 and the pull-up member 24 are mechanically connected. The operative connection between member 24 and levers 22 can be understood from FIGS. 3 and 5. Member 24 is fixed in accommodation 29 in housing 30 which is fixedly connected to accommodation body 9. In breakthroughs 20, plunger gripping levers 22 are mounted on the accommodation body 9 on swivelling axles 21.

Releasing levers 26 project towards the inside from the inner sides of the actuation arms 18 of the syringe gripping levers 14. The releasing levers 26 are connected to the upper ends of the actuation arms 18 and inclined to the axis of the syringe plunger 11 in an acute angle.

The releasing levers 26 have roundings 27 at their ends.

The accommodation body 9 is driven by means of mechanical plunger setting devices 28. The same comprise the pull-up member 24 in the form of a pull-up button, which is arranged by means of a centre spigot (not shown) in a centre accommodation 29 in a housing 30 which is fixedly connected to the accommodation body 9. The centre spigot is guided through the longitudinal slit 25 of the pipette housing 2, and the pull-up button 24 is arranged on the outer side of the pipette housing 2. The plunger setting devices 28 comprise a plurality of devices such as the pull-up member 24. The pull-up member 24 is arranged in a centre accommodation 29 of housing 30 by means of a spigot (not shown). The housing 30 in turn is connected to the body 9 allowing for driving body 9 by device 28. The meaning of the term "centre spigot" is that the spigot is engaged centrally into the centre accommodation 29. The slit 25 is shown in FIGS. 1 and 10. As slit 25 is on the outer housing of the pipette, it is not shown in FIG. 2, where the housing is missing. Further the plunger setting devices 28 comprise a threaded spindle 31 which is also fixedly connected to the accommodation body 9. A cover-up sleeve 32 sits on the spindle 31, the axial position of the sleeve 32 on spindle 31 being adjustable by means of turning knob 33. Further, an actuation member 35 comprising an actuation lever 38 is pivotally mounted in the upper region of the pipette housing 2. A ratchet 41.2 is pivotally mounted on the actuation lever 38. The actuation lever 38 is pushed towards the upside by means of a spring (not shown). Leaf spring 42 pre-stresses the ratchet 41.2, so that the same slips towards the downside over the cover-up sleeve 32 when the actuation button 39 is moved and thereafter it falls into the thread of the threaded spindle 31 to move the same towards the downside, corresponding to the further movement of the actuation member 35 towards the downside. Accommodation body 9 is driven upwards by pull-member 24 and driven downwards by actuation lever 38 via ratchet 41.2 and spindle 31.

Further, the plunger setting devices 28 comprise a threaded spindle 31 (alternatively, a toothed bar), which is also fixedly connected to the accommodation body 9. On the threaded spindle 31 sits a cover-up sleeve 32, whose axial position on the threaded spindle 31 is adjustable by means of a turning knob 33. For this purpose, the turning knob 33 has a not shown guiding cam, which co-operates with a guiding spigot 34 which is fixedly connected to the threaded spindle 31. By regulating the turning knob 33, the cover-up sleeve 32 can be brought with a lower end into more or less overlap with the thread of the threaded spindle 31, in order to set the metering amount. The position of the sleeve 32 sets the metering amount because this position determines when ratchet 41.2 falls into the thread of the threaded spindle 31 to move the same downside when actuation member 34 is moved downwards. When sleeve 32 is in an upper position, spindle 31 will move a long path downwards during a downward stroke of actuation member 35. When sleeve 32 is positioned in a lower position, spindle 31 will only move a short path downwards during a downward stroke of actuation member 35.

Figure 11:
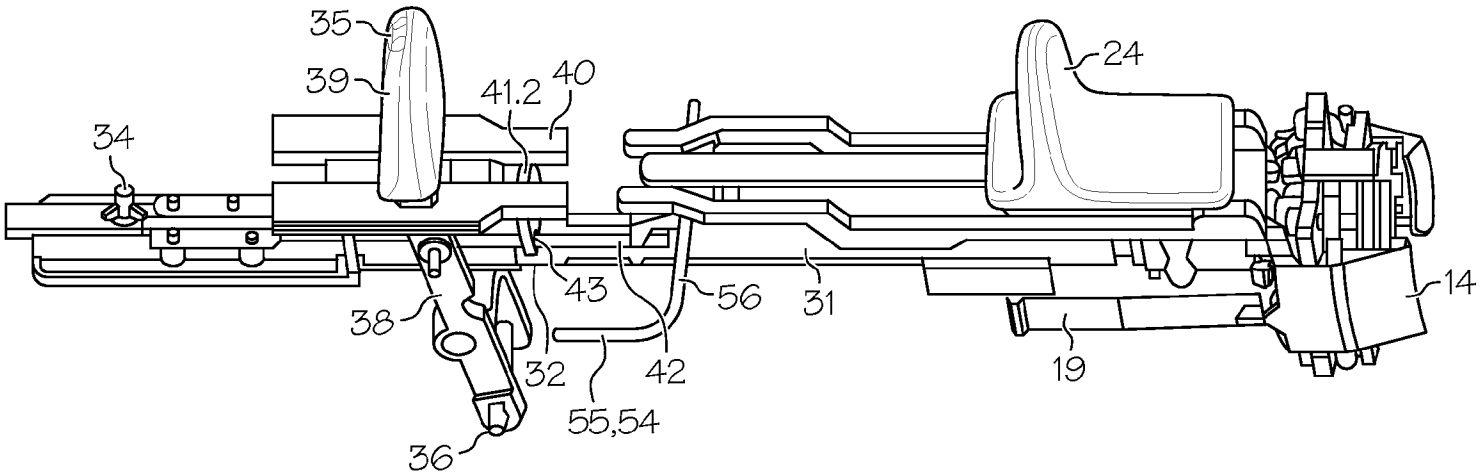
FIG. 11 fastening devices, plunger setting devices, remaining stroke lock and ejection slider of the same pipette in a perspective view.
Figure 12:
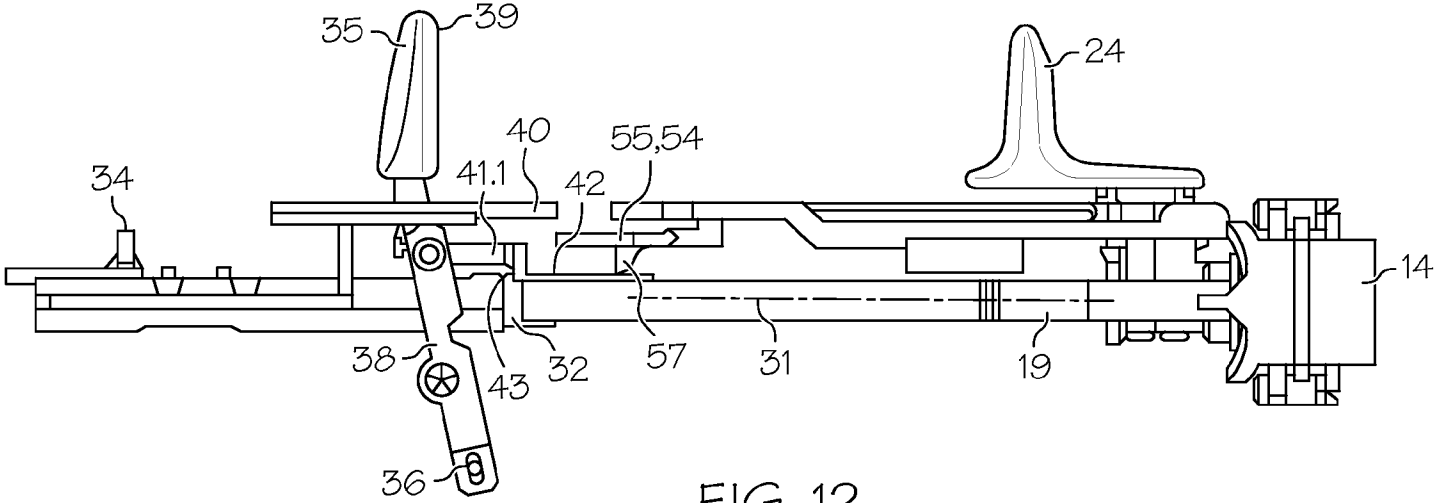
FIG. 12 fastening devices, plunger setting devices, remaining stroke lock and ejection slider of the same pipette in a side view.

Further, an actuation member 35 is arranged in the upper region of the pipette housing 2. The same comprises an actuation lever 38, pivotally mounted around a swivelling axle 36 in a bearing pedestal 37, with an actuation button 39 arranged at the end. Below the actuation button 39, a stop 40 sits on the actuation lever 38 (FIGS. 2, 11, and 12). The actuation lever 38 is guided towards the outside through openings 41 of the pipette housing 2, which are covered up by the stop 40. The actuation button 39 is actuable from the outside. Swivelling axle 36 is shown in FIGS. 11 and 12. Swivelling axle 36 is mounted in a bearing pedestal 37 is shown in FIG. 2. The openings 41 are shown in FIGS. 1 and 10.

A ratchet 41.2 is pivotally mounted on the actuation lever 38. The actuation lever 38 is pushed towards the upside by means of a not shown spring, and the ratchet 41.2 is pre-stressed towards the threaded spindle 31 by means of a further, not depicted spring.

A leaf spring 42 is fixed on the cover-up sleeve 32, which extends parallel to the threaded spindle 31 and projects over the front edge of the cover-up sleeve 32. This leaf spring 42 is guided through a hole 43 in a laterally projecting wing 41.1 of the ratchet 41.2. The leaf spring 42 prestresses the ratchet 41.2, so that the same slips towards the downside over the cover-up sleeve 32 when the actuation button 39 is moved, and thereafter it falls into the thread of the threaded spindle 31 to move the same towards the downside, corresponding to the further movement of the actuation member 35 towards the downside. The portion of the ratchet 41.2 resting on sleeve 32 in FIGS. 7.1 and 12.1 slips over the sleeve 32 when lever 38 is moved downwardly.

A not represented cam sits on the portion of the threaded spindle 31 arranged inside the cover-up sleeve 32. This cam is guided through in a longitudinal slit of the cover-up sleeve 32, which extends below the leaf spring 42. The cam is moved along, corresponding to the movement of the threaded spindle 31 towards the downside. As soon as the cam hits a tab 42.1 of the leaf spring 42, the same is somewhat deflected from the threaded spindle 31. As a result, the tab 42.1 can no more fall into the thread. Through this, a remaining stroke lock is caused, which prevents that a residual amount of a liquid falling below a preset metering amount is delivered from the syringe 5. The cam is arranged and guided in a longitudinal slit of sleeve 32 which extends below leaf spring 42. The cam moves with a movement of spindle 31 actuated by tab 42.1 downwards. When the cam hits tab 42.1 on leaf spring 42 as shown in FIGS. 12.1 and 7.1, leaf spring 42 is deflected away from spindle 31. Consequently, tab 42.1 is disengaged from the thread.

Figure 4:
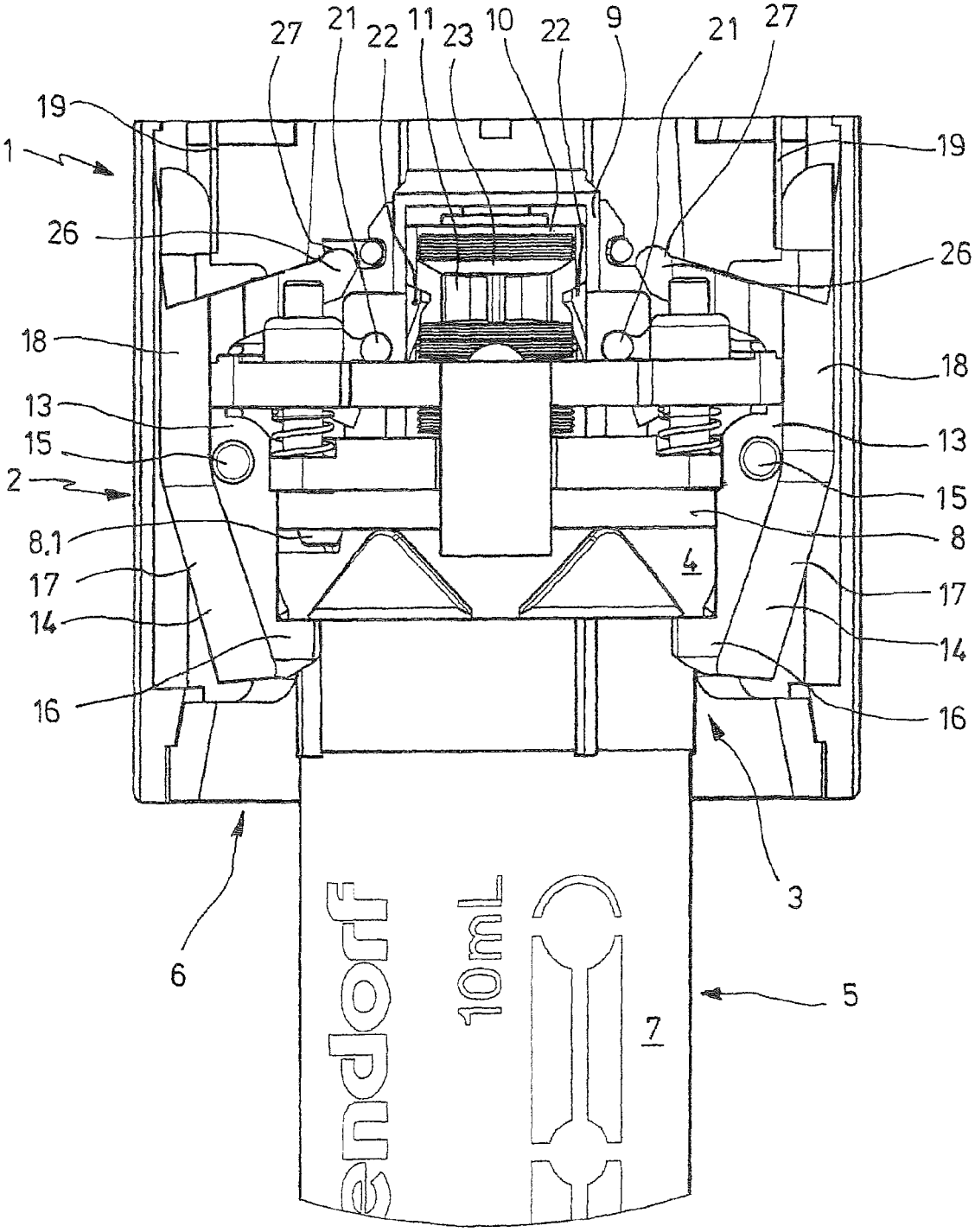
FIG. 4 accommodation body with ejection slider in a magnified perspective view.

An ejection slider 44 is arranged in the pipette housing 2 in a guiding. The ejection slider 44 has two rods 45 extending parallel to the axis of the syringe plunger 17, which are guided in guidings (not shown) in the pipette housing 2 (FIG. 4, 6). The rods 45 are connected with each other at their ends by bracing struts 46, 47. The bracing strut 46 has a bearing surface 48 at its downside. By displacing the ejection slider 44 in the guidings, it is possible to make the bearing surface 48 sit close to the roundings 27 of the releasing levers 26. The guiding, guides the two rods 45 of slider 44 parallel to the axis of the syringe plunger 17.

At the other side, the bracing strut 46 has a take-along surface 49. The housing 30 of the accommodation body 9 is arranged between the rods 45 and the bracing struts 46, 47. It forms a take-along element 30, which takes along the ejection slider 44 when it hits the take-along surface 49.

The bracing strut 47 has two cams 50 on its upper side, which each one at a time have a ramp on the topside.

Figure 5:
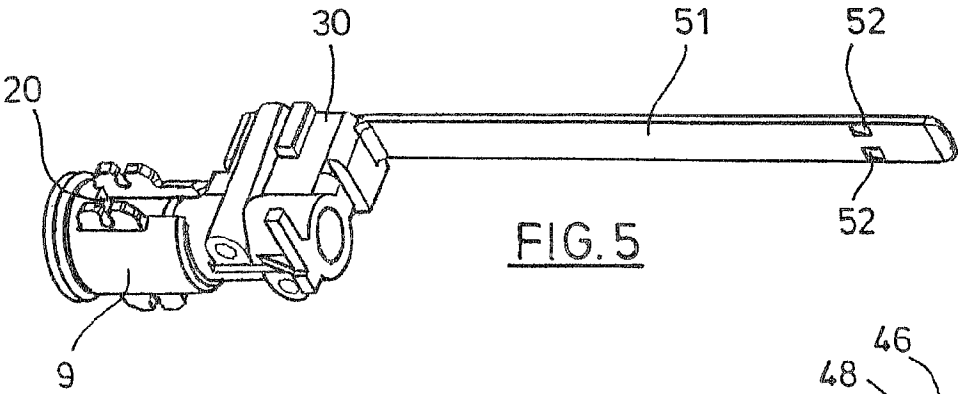
FIG. 5 accommodation body with take-along element and tongue in a magnified perspective view.
Figure 6:
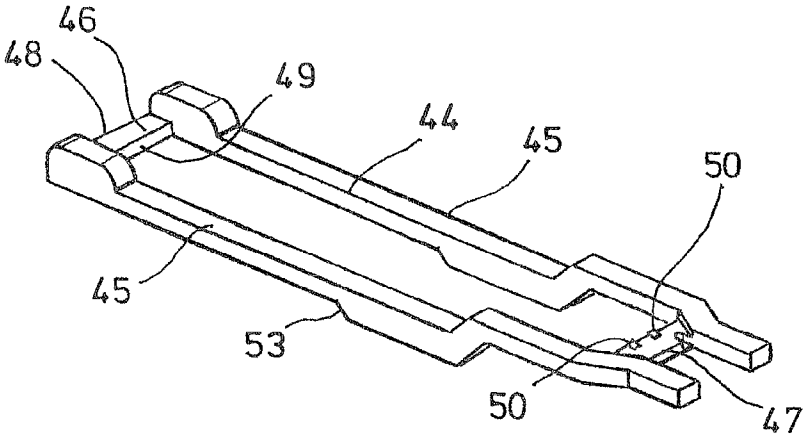
FIG. 6 ejection slider in a magnified perspective view.
Figure 4:
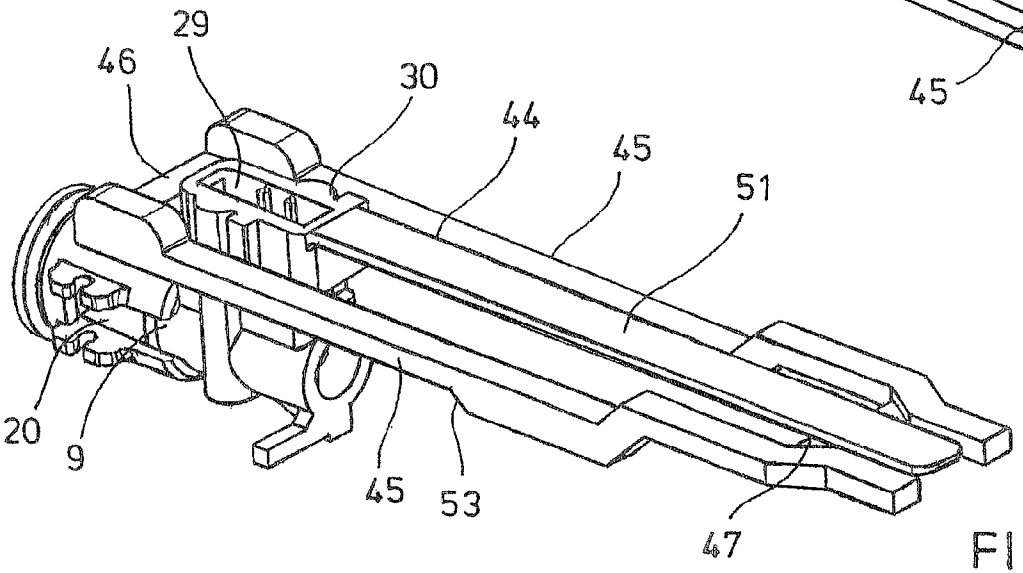

The housing 30 connected to the accommodation body 9 is provided with a tongue 51, which extends parallel to the plunger accommodation (FIG. 5). The tongue 30 has recesses 52 at its lower side, which are formed complementary to the cams 50 on the bracing strut 47. The cams 50 can engage into the recesses 52. When the accommodation body 9 and with it the tongue 51 is moved upward, they take along the ejection slider 44.

On the side turned away from the tongue 51, the rods 45 have a ramp 53 each one at a time. Not shown housing-stationary cams are assigned to the ramps 53.

The pipette 1 is used as follows:

At first, the metering amount is set by means of the turning knob 33.

Further, a syringe 5 is inserted.

The accommodation body 9 is displaced towards the accommodation 3 as far as possible, by means of the pull-up member 24. With the upper end of the syringe plunger 11 and the syringe flange 4 ahead, a syringe 5 is inserted into the accommodation 3 through the axial opening 6. In this, the upper end of the syringe plunger 11 sinks into the plunger accommodation 10 of the accommodation body 9, and the syringe flange 4 is pushed against the spring stressed abutment 8. In this, the syringe gripping levers 14 and the plunger gripping levers 22 are pushed towards the outside against the spring action, and then they snap in behind the syringe flange 4 and the plunger collar 23 with their gripping ends, due to the spring action. Thereafter, the syringe 5 is fixed in the accommodations 3, 10.

Figure 8:
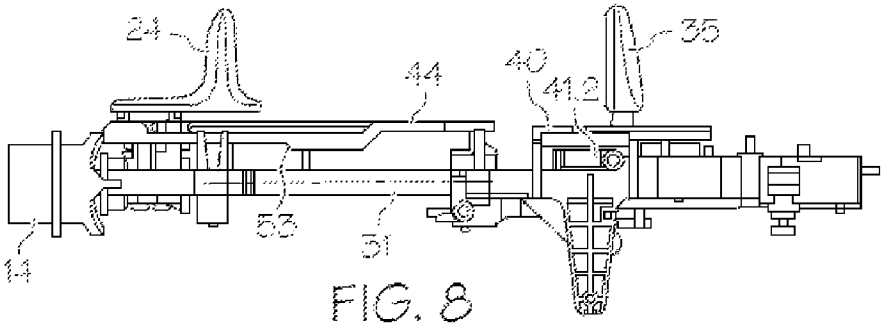
FIG. 8 the same assembly parts, with the ejection slider in the releasing position, in a side view.

Liquid can be aspirated into the syringe 5 by displacing the pull-up member 24 towards the upside. A metering amount is set by means of the turning knob 33. The syringe plunger 11 is moved downward by actuating the actuation member 35, and the desired amount of liquid is delivered. When the syringe 5 is almost empty, so that only a residual amount is still present therein, the leaf spring 42 prevents the ratchet 41.2 from falling into the threaded spindle 31. Then, the user can deliver the residual amount by pushing the pull-up element 24 towards the downside. In this, the take-along element 30 shoves along the ejection slider, so that the ramps 53 run over the cams and lift the upper end of the ejection slider 44 (FIG. 8).

Figure 9:
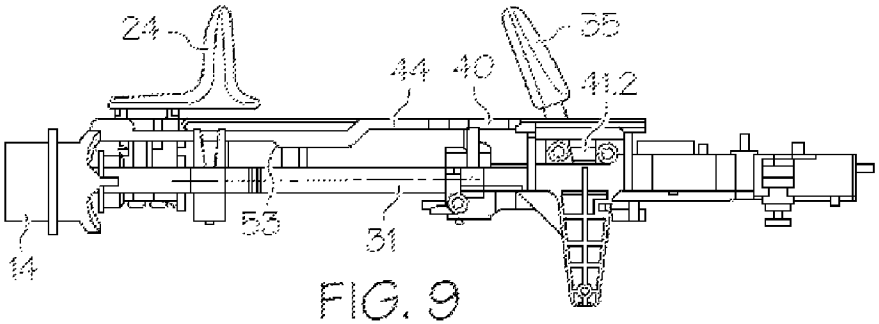
FIG. 9 the same assembly parts, with actuated ejection slider, in a side view.

In this, the upper end of the ejection slider 44 arrives in the movement range of the stop 40 from a range below the movement range thereof. By re-actuating the actuation member 35, the stop 40 can be shifted against the upper end of the ejection slider, and the ejection slider 44 presses the releasing levers 26, so that the syringe gripping levers 14 and the plunger gripping levers 22 are opened and the syringe falls out of the accommodation and the plunger accommodation (FIG. 9).

Figure 7:
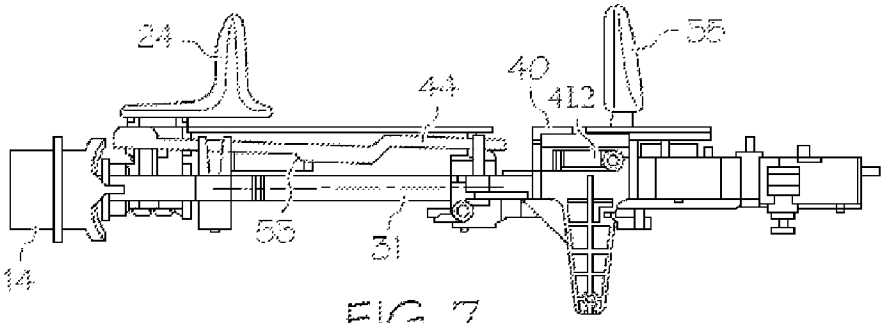
FIG. 7 fastening devices, plunger setting devices and ejection slider of the same pipette with the ejection slider in a holding position, in a side view.

Thereafter, a new syringe 5 can be inserted into the accommodations. Liquid is aspirated through pulling it up by means of the pull-up member 24. In this, the ejection slider is moved somewhat along towards the upside due to the cams 50 engaging into the recesses 52, until the ramps have run over the cams 50 and the cams 50 fall out of the recesses 52 (FIG. 7). This can be supported by a not shown spring, which acts on the side of the ejection slider 44 facing the pull-up member.

Thereafter, the syringe 5 can be re-emptied by actuating the actuation member 35 one or plural times, wherein the stop 40 does not come into contact with the upper end of the ejection slider 44, because the latter is not in the movement range of the stop 40. Only after delivery of the residual amount, the syringe 5 can be detached from the pipette 1 in the described manner.

The realization according to FIGS. 10 to 12.1 differs from that one described above in that there is additionally an adjustment member 54 in the form of a lever arm 55 on an axle 56 which carries a controlling cam 57. The axle 56 is pivotally mounted in the pipette housing 2. The lever arm 55 is accessible from the outside.

In the shown position of the lever arm 54, the controlling cam 57 does not touch the leaf spring 42, nor does it touch the ejection slider 44. By actuating the actuation button 39, liquid can be delivered from a syringe 5 held in the fastening devices 14, 22, until a residual amount is reached. Then, the leaf spring 42 prevents the ratchet 41.2 from falling into the thread of the threaded spindle 31. By swiveling the lever arm 54 towards the downside, the controlling cam 57 is pushed against the leaf spring 42 from the upside. As a consequence, the ratchet 41.2 can fall into the threaded spindle anew.

Thereafter, the residual amount can be delivered by re-actuating the actuation member 35. In this, the take-along element 30 displaces the ejection slider 44, so that the ramps 53 run over the cams and the upper end of the ejection slider 44 arrives in the movement range of the stop 40. In this, the ejection slider 44 can resiliently sit close to the inner side of the stop 40. After relief of the actuation member 35, the upper end of the ejection slider 44 can enter the movement range of the stop 40. As the case may be, this is supported by swivelling the lever arm 54 towards the upside, so that the controlling cam 57 hits the side of the ejection slider 44 facing the threaded spindle 31. A further actuation of the actuation button 35 causes a displacement of the ejection slider 44, so that the releasing levers 26 are actuated and the syringe 5 is ejected.

Thereafter, a new syringe 5 can be inserted. The lever arm 54 is moved back into the starting position, in which the controlling cam does not touch the leaf spring 42, nor does it touch the ejection slider 44. By pushing the pull-up button 24 towards the upside, liquid is aspirated, and in this the ejection slider 44 is swivelled out of the movement range of the stop 40 in the already described way.

Thereafter, liquid can be delivered in the already described way and the syringe 5 can be ejected.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. A pipette comprising:

a pipette housing comprising, an accommodation constructed and arranged to engage a fastening portion of a syringe cylinder of a syringe, a plunger accommodation in an accommodation body for a syringe plunger of the syringe, a plurality of syringe gripping levers and a plurality of plunger gripping levers, the syringe gripping levers and the plunger gripping levers constructed and arranged for reversibly fixing the fastening portion and the syringe plunger in the accommodation and the plunger accommodation, the syringe gripping levers having releasing levers, plunger setting devices constructed and arranged to shift the accommodation body in the pipette housing, a pull-up member for removing the accommodation body from the accommodation, and an actuation member for drawing the accommodation body proximate to the accommodation, an ejection slider constructed and arranged to be displaced into a releasing position from a holding position, the ejection slider being further constructed and arranged to be shifted along a housing-stationary guiding in order to actuate the releasing levers, and a displacing mechanism constructed and arranged to displace the ejection slider from the holding position into the releasing position and from the releasing position into the holding position.

2. A pipette according to claim 1, wherein the fastening portion and the syringe plunger are constructed and arranged to be axially shiftable into a fastening position via axial openings of the accommodation and the plunger accommodation.

3. A pipette according to claim 1, wherein the plurality of syringe gripping levers and a plurality of plunger gripping levers have radially closable gripping devices for fixing the fastening portion and the syringe plunger in a fastening position.

4. A pipette according to claim 3, wherein the syringe gripping levers are pivotally mounted in the pipette housing, and the plunger gripping levers are pivotally mounted in the accommodation body, the syringe gripping levers and the plunger gripping levers each having a gripping arm and an actuation arm, the actuation arm of the syringe gripping levers have inner sides and outsides and contact sites on the inner sides of the actuation arms, which, by actuating the actuation arms at the outside, are turnable against the actuation arms of the plunger gripping levers, and the plunger gripping levers, and the syringe gripping levers have releasing levers projecting towards the inside on the actuation arms.

5. A pipette according to claim 1, wherein the displacing mechanism constructed and arranged to displace the ejection slider is coupled to the plunger setting devices.

6. A pipette according to claim 5, the ejection slider further comprising a first take-along surface, a first take-along element connected to the accommodation body, a first guiding mechanism, a second guiding mechanism, a second take-along surface, and a second take-along element.

7. A pipette according to claim 6, wherein the first take-along element is the housing of a spigot accommodation for a spigot of the pull-up member.

8. A pipette according to claim 6, wherein the second take-along surface and the second take-along element are ramp elements or cam elements of the ejection slider and the accommodation body.

9. A pipette according to claim 8, wherein at least one ramp element or cam element is arranged on a tongue connected with the accommodation body.

10. A pipette according to claim 8, wherein at least one ramp element or cam element is arranged on at least one of the bracing struts.

11. A pipette according to claim 6, wherein the first guiding mechanism and the second guiding mechanism are ramp elements or cam elements.

12. A pipette according to claim 1, wherein the displacing mechanism has a manually actuatable adjustment member constructed and arranged to be adjusted into a first adjustment position for displacing the ejection slider into the holding position, and into a further adjustment position for displacing the ejection slider into the releasing position.

13. A pipette according to claim 1, wherein the ejection slider is constructed and arranged to be displaced from the holding position into the releasing position and from the releasing position into the holding position by the displacing mechanism only when the accommodation body is arranged in an end portion of a displacement range, proximate to the accommodation.

14. A pipette according to claim 13, further comprising an automatic suspending mechanism constructed and arranged to automatically suspend the displaceability of the accommodation body by the actuation member when the accommodation body is proximate to the end portion of the displacement range.

15. A pipette according to claim 14, wherein the accommodation body is displaceable by actuating the pull-up member in the end portion of the displacement range.

16. A pipette according to claim 14, further comprising a canceling mechanism constructed and arranged to cancel an automatic suspension of the displaceability of the accommodation body by the actuation member through a manually actuatable adjustment member, the manually actuatable adjustment member being settable between a first adjustment position in which the automatic suspension is active, and a further adjustment position in which the automatic suspension is cancelled.

17. A pipette according to claim 1, the ejection slider having two parallel rods which are connected with each other by transversely directed bracing struts.

18. A pipette according to claim 17, wherein the first take-along surface and the second take-along surface are arranged on sides of the bracing struts.

19. A pipette according to claim 1, the actuation member comprising and at least one stop.

* * * * *